US009485572B2

(12) United States Patent
Endo et al.

(10) Patent No.: US 9,485,572 B2
(45) Date of Patent: Nov. 1, 2016

(54) SOUND PROCESSING DEVICE, SOUND PROCESSING METHOD, AND PROGRAM

(71) Applicant: FUJITSU LIMITED, Kawasaki-shi, Kanagawa (JP)

(72) Inventors: Kaori Endo, Yokohama (JP); Yoshiteru Tsuchinaga, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 1 day.

(21) Appl. No.: 14/199,084

(22) Filed: Mar. 6, 2014

(65) Prior Publication Data

US 2014/0185818 A1 Jul. 3, 2014

Related U.S. Application Data

(63) Continuation of application No. PCT/JP2011/073726, filed on Oct. 14, 2011.

(51) Int. Cl.

| | |
|---|---|
| ***H04R 3/00*** | (2006.01) |
| ***H04R 3/02*** | (2006.01) |
| ***G10L 21/0208*** | (2013.01) |
| ***G10L 21/0216*** | (2013.01) |

(52) U.S. Cl.

CPC ..... *H04R 3/002* (2013.01); *G10L 21/0208* (2013.01); *H04R 3/02* (2013.01); *G10L 2021/02082* (2013.01); *G10L 2021/02166* (2013.01); *H04R 3/005* (2013.01); *H04R 2499/11* (2013.01)

(58) Field of Classification Search

CPC .. H04R 3/002; H04R 3/005; H04R 2499/11; G10L 2021/02082; G10L 2021/02166

See application file for complete search history.

(56) References Cited

U.S. PATENT DOCUMENTS

| | | | | |
|---|---|---|---|---|
| 6,236,725 | B1 | 5/2001 | Takada et al. | |
| 2009/0238373 | A1* | 9/2009 | Klein | 381/66 |
| 2010/0081487 | A1* | 4/2010 | Chen et al. | 455/575.1 |
| 2011/0019832 | A1 | 1/2011 | Itou et al. | |
| 2011/0158426 | A1 | 6/2011 | Matsuo | |

FOREIGN PATENT DOCUMENTS

| | | | |
|---|---|---|---|
| JP | 11-004288 | A | 1/1999 |
| JP | 11-027375 | A | 1/1999 |

(Continued)

OTHER PUBLICATIONS

Extended European Search Report dated Mar. 31, 2015 issued with respect to the corresponding European Patent Application No. 11873877.2.

(Continued)

*Primary Examiner* — Sonia Gay
(74) *Attorney, Agent, or Firm* — Maschoff Brennan

(57) ABSTRACT

A sound processing device includes a first calculation unit configured to calculate a suppression gain of noise by using respective input signals input from a plurality of microphones; an integration unit configured to obtain an integration gain by using a suppression gain of an acoustic echo and the suppression gain of the noise; an application unit configured to apply the integration gain to one input signal among the plurality of input signals; and a second calculation unit configured to calculate the suppression gain of the acoustic echo by using signals to which the integration gain is applied, output signals that are output to a replay device, and the one input signal.

8 Claims, 13 Drawing Sheets

(56) References Cited

FOREIGN PATENT DOCUMENTS

| | | | |
|---|---|---|---|
| JP | 2010-028653 | A | 2/2010 |
| JP | 2011-139378 | A | 7/2011 |
| WO | 2009/104252 | A1 | 8/2009 |

OTHER PUBLICATIONS

Kobayashi K et al: "A Microphone Array System With Echo Canceller", Electronics & Communications in Japan, Part III—Fundamentalelectronic Science, Wiley, Hoboken, NJ, US, vol. 89, No. 10, Oct. 1, 2006, pp. 23-32, XP001243707, ISSN: 1042-0967, DOI: 10.1002/CJC.20090.

Office Action mailed on Dec. 16, 2015 issued with respect to the corresponding Chinese Patent Application No. 201180073541.1 Full translated office action.

Office Action dated Sep. 2, 2014 issued with respect to the corresponding Japanese Patent Application No. 2013-538414.

Kazunori Kobayashi et al.,'A Microphone Array System with Echo Canceller', IEICE (The institute of Electronics, Information and Communication Engineers) Journal, A vol. J87-A, No. 2, pp. 143-152, Feb. 2004.

* cited by examiner

SOUND PROCESSING DEVICE, SOUND PROCESSING METHOD, AND PROGRAM

CROSS-REFERENCE TO RELATED APPLICATION

This application is a U.S. continuation application filed under 35 USC 111(a) claiming benefit under 35 USC 120 and 365(c) of PCT Application PCT/JP2011/073726 filed on Oct. 14, 2011, the entire contents of which are incorporated herein by reference.

BACKGROUND

Conventionally, there is a technology for performing noise suppression by using input signals of a plurality of microphones and a technology for performing acoustic echo suppression. For example, when an adaptive microphone array and an echo canceller are simply connected, the learning of the echo canceller becomes delayed with respect to the echo path variation by the microphone array, and the echo cancellation performance deteriorates temporarily.

Accordingly, there has been proposed an echo canceller integrated microphone array which performs learning of the microphone array and learning of the echo canceller by one calculating formula.

PRIOR ART

Non-patent Document 1: Kazunori Kobayashi et al., "Echo canceller integrated microphone array", IEICE (The institute of Electronics, Information and Communication Engineers) Journal, A Vol. J87-A, No. 2, pp. 143-152, February, 2004

However, the conventional technology has a problem whereas the calculation amount increases and the processing amount increases, as the covariance of voice components, echo components, and noise components is obtained, and the conditions when calculating a filter coefficient therefore increase. Furthermore, in a case of suppressing noise by performing echo cancelling, the echo cancelling has to be performed corresponding to the number of microphones, which increases the calculation amount.

SUMMARY

A sound processing device according to an embodiment of the disclosure includes a first calculation unit configured to calculate a suppression gain of noise by using respective input signals input from a plurality of microphones; an integration unit configured to obtain an integration gain by using a suppression gain of an acoustic echo and the suppression gain of the noise; an application unit configured to apply the integration gain to one input signal among the plurality of input signals; and a second calculation unit configured to calculate the suppression gain of the acoustic echo by using signals to which the integration gain is applied, output signals that are output to a replay device, and the one input signal.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

In the following, embodiments are described with reference to drawings.

First Embodiment

Configuration

Figure 1:
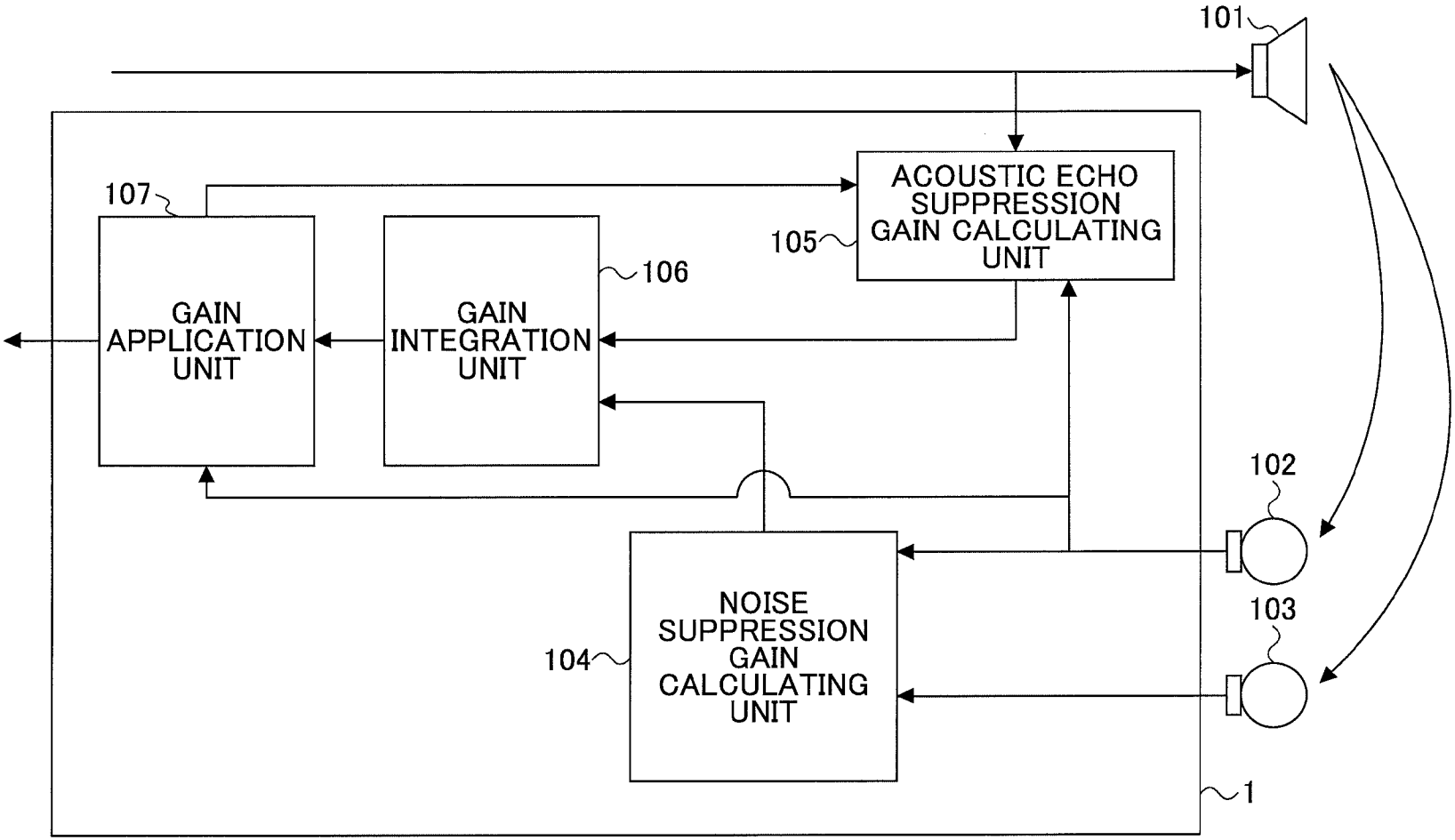
FIG. 1 is a block diagram illustrating an example of the configuration of a sound processing device according to a first embodiment.

First, a description is given of the configuration of a sound processing device 1 according to a first embodiment. FIG. 1 is a block diagram illustrating an example of the configuration of the sound processing device 1 according to the first embodiment. As illustrated in FIG. 1, the sound processing device 1 includes a noise suppression gain calculating unit 104, an acoustic echo suppression gain calculating unit 105, a gain integration unit 106, and a gain application unit 107. The sound processing device 1 is connected to a replay device 101, a first microphone 102, and a second microphone 103.

Note that the sound processing device 1 may be constituted to include the replay device 101, the first microphone 102, and the second microphone 103. Furthermore, in the example of FIG. 1, there are two microphones; however, there may be three or more microphones.

The replay device 101 is a speaker and a receiver, etc., and replays output signals. The sound replayed by the replay device 101 becomes an acoustic echo, which is input to the first microphone 102 and the second microphone 103. The replayed sound is a voice, a musical sound, etc.

The first microphone 102 and the second microphone 103 receive input signals, and output the respective input signals to the noise suppression gain calculating unit 104. There are cases where the input signals include an acoustic echo. The input signals input to the first microphone 102 are referred to as "first input signals", and the input signals input to the second microphone 103 are referred to as "second input signals".

The noise suppression gain calculating unit 104 acquires first input signals from the first microphone 102, and acquires second input signals from the second microphone 103. The noise suppression gain calculating unit 104 performs time-frequency conversion on the acquired first input signals and second input signals, and estimates the noise components. A known technology may be used as the technology of estimating the noise components. Noise is also referred to as "unwanted sound" or "undesired sound".

For example, Non-patent Document 1 describes obtaining noise components by using filters respectively connected to a plurality of microphones, according to a condition expression where the output after passing the filter is zero. Furthermore, another technology of estimating the noise components from a spectrum of input signals of a plurality of microphones may be used; for example, the technology of Japanese Laid-Open Patent Publication No. 2011-139378.

The noise suppression gain calculating unit 104 calculates the suppression gain of noise for each frequency, based on the spectrum of the estimated noise components and the spectrum of the first input signals. In the first embodiment, for example, the suppression gain of noise, etc., is calculated by using the first input signals as a standard. For example, the suppression gain of noise is calculated as the difference between the spectrum of the first input signals and the spectrum of the estimated noise components. The suppression gain of noise may be calculated by multiplying this difference by a predetermined value.

The acoustic echo suppression gain calculating unit 105 acquires output signals output to the replay device 101, signals output from the gain application unit 107 described below, and the first input signals from the first microphone 102.

The acoustic echo suppression gain calculating unit 105 performs time-frequency conversion on the output signals and the first input signals, and estimates the acoustic echo by using signals output from the gain application unit 107. A known technology may be used as the technology to estimate the acoustic echo.

For example, the acoustic echo suppression gain calculating unit 105 uses a known configuration including a typical application filter and a subtracter to calculate the spectrum of the acoustic echo components, and calculates the suppression gain of the acoustic echo for each frequency.

The gain integration unit 106 acquires the suppression gain of noise of each frequency from the noise suppression gain calculating unit 104 and acquires the suppression gain of the acoustic echo of each frequency from the acoustic echo suppression gain calculating unit 105.

The gain integration unit 106 obtains a single gain from two gains according to a predetermined method. In the following, the single gain is referred to as an "integrated gain". The gain integration unit 106 outputs the integrated gain to the gain application unit 107. As the predetermined method, for example, the following four methods may be considered.

Method 1

The gain integration unit 106 selects, for each frame and each frequency, the smaller gain between the suppression gain of noise and the suppression gain of the acoustic echo, by using Formula (1). The gain integration unit 106 sets the selected gain as the integrated gain.

$$\mathrm{Gain}(n,f)=\mathrm{MIN}(ma\mathrm{Gain}(n,f),ec\mathrm{Gain}(n,f))f=0,\ldots,127,n=0,1,\ldots \quad \text{Formula (1)}$$

Gain (n, f) INTEGRATED GAIN
maGain (f) SUPPRESSION GAIN OF NOISE
ecGain (n, f) SUPPRESSION GAIN OF ACOUSTIC ECHO
n: INDEX OF FRAME
f: INDEX OF FREQUENCY According to Method 1, the lower gain indicating a coefficient of less than or equal to one to be multiplied by the amplitude spectrum, is selected. Therefore, the suppression increases, and the suppression effect on the acoustic echo and the noise is high.

Method 2

The gain integration unit 106 selects, for each frame and each frequency, the larger gain between the suppression gain of noise and the suppression gain of the acoustic echo, by using Formula (2). The gain integration unit 106 sets the selected gain as the integrated gain.

$$\mathrm{Gain}(n,f)=\mathrm{MAX}(ma\mathrm{Gain}(n,f),ec\mathrm{Gain}(n,f))f=0,\ldots,127,n=0,1,\ldots \quad \text{Formula (2)}$$

Gain (n, f) INTEGRATED GAIN
maGain (f) SUPPRESSION GAIN OF NOISE
ecGain (n, f) SUPPRESSION GAIN OF ACOUSTIC ECHO
n: INDEX OF FRAME
f: INDEX OF FREQUENCY According to Method 2, the higher gain indicating a coefficient of less than or equal to one to be multiplied by the amplitude spectrum, is selected. Therefore, the suppression decreases, and the distortion of the sound is small.

Method 3

The gain integration unit 106 calculates, for each frame and each frequency, an average value by using the suppression gain of noise and the suppression gain of the acoustic echo, by using Formula (3). The gain integration unit 106 sets the calculated average value as the integrated gain.

$$\mathrm{Gain}(n,f)=(ma\mathrm{Gain}(n,f)+ec\mathrm{Gain}(n,f))/2f=0,\ldots,127,n=0,1,\ldots \quad \text{Formula (3)}$$

Gain (n,f) INTEGRATED GAIN
maGain (f) SUPPRESSION GAIN OF NOISE
ecGain (n,f) SUPPRESSION GAIN OF ACOUSTIC ECHO
n: INDEX OF FRAME
f: INDEX OF FREQUENCY According to Method 3, the average value is set as the integrated gain, and therefore a balance is attained between the suppression effects on the acoustic echo and the noise, and the distortion of the sound.

Method 4

The gain integration unit 106 calculates, for each frame and each frequency, a weighted average value by using the suppression gain of noise and the suppression gain of the acoustic echo, by using Formula (4). The gain integration unit 106 sets the calculated weighted average value as the integrated gain.

$$\mathrm{Gain}(n,f)=(\alpha\times ma\mathrm{Gain}(n,f)+(1-\alpha)\times ec\mathrm{Gain}(n,f))f=0,\ldots,127,n=0,1,\ldots \quad \text{Formula (4)}$$

Gain (n, f) INTEGRATED GAIN
maGain (f) SUPPRESSION GAIN OF NOISE
ecGain (n, f) SUPPRESSION GAIN OF ACOUSTIC ECHO
n: INDEX OF FRAME
f: INDEX OF FREQUENCY
α: COEFFICIENT OF WEIGHTED AVERAGE (0~1)

According to Method 4, the weighted average value is set as the integrated gain, and therefore a balance is attained between the suppression effects on the acoustic echo and the noise, and the distortion of the sound, and this balance is adjusted.

The gain integration unit 106 uses one of the above-described Methods 1 through 4 to obtain the integrated gain. Furthermore, the gain integration unit 106 may be able to select one of the Methods 1 through 4, and use the selected method to obtain the integrated gain.

The gain application unit 107 applies the integrated gain acquired from the gain integration unit 106 to the first input signals acquired from the first microphone 102. For example, the gain application unit 107 converts the first input signals into frequency components, and multiplies a coefficient indicating the integrated gain by the spectrum of the first input signals.

Accordingly, the first input signals to which the integrated gain is applied become signals in which the acoustic echo components and the noise components are suppressed. These signals are output to a processing unit of a latter stage and the acoustic echo suppression gain calculating unit 105.

Configuration of Noise Suppression Gain Calculating Unit

Figure 2:
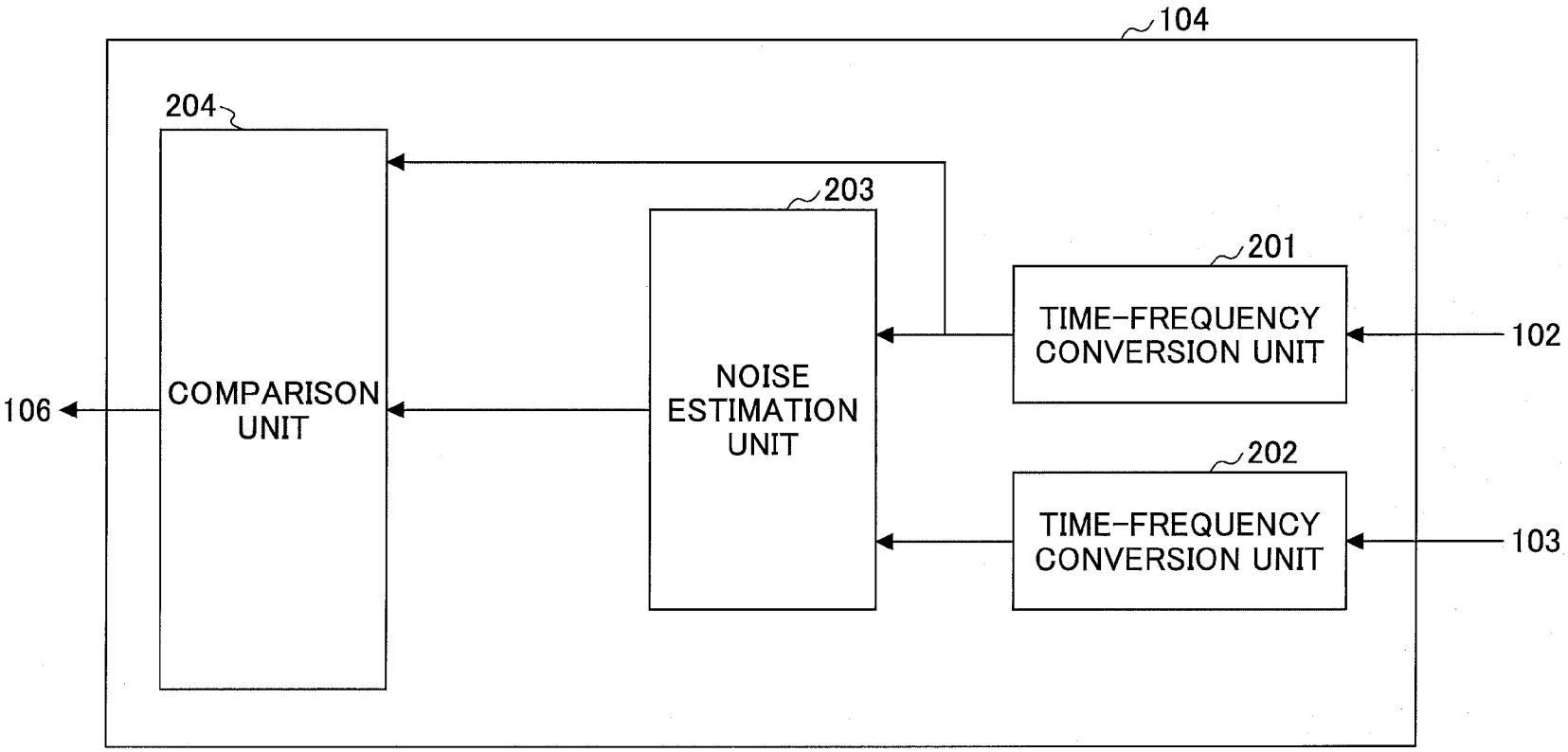
FIG. 2 is a block diagram illustrating an example of the configuration of a noise suppression gain calculating unit according to the first embodiment.

Next, a description is given of the configuration of the noise suppression gain calculating unit 104. FIG. 2 is a block diagram illustrating an example of the configuration of the noise suppression gain calculating unit 104 according to the first embodiment. The noise suppression gain calculating unit 104 illustrated in FIG. 2 includes a time-frequency conversion unit 201, a time-frequency conversion unit 202, a noise estimation unit 203, and a comparison unit 204.

The time-frequency conversion unit 201 performs time-frequency conversion on the first input signals, and obtains the spectrum. The time-frequency conversion unit 202 performs time-frequency conversion on the second input signals, and obtains the spectrum. The time-frequency conversion is, for example, Fast Fourier Transform (FFT).

The time-frequency conversion unit 201 outputs the obtained spectrum of the first input signals to the noise estimation unit 203 and the comparison unit 204. The time-frequency conversion unit 202 outputs the obtained spectrum of the second input signals to the noise estimation unit 203.

The noise estimation unit 203 acquires the spectrum of the first input signals and the spectrum of the second input signals, and performs noise estimation. The noise estimation unit 203 uses a known technology to estimate the spectrum of the noise components. The estimated spectrum of the noise components is output to the comparison unit 204.

The comparison unit 204 compares the spectrum of the first input signals and the spectrum of the noise components, and calculates a gain for suppressing noise for each frequency. In the following, this gain is also referred to as a "suppression gain of noise". The comparison unit 204 sets the ratio of noise components included in the first input signals as the suppression gain of noise. Furthermore, the suppression gain of noise may be calculated with a relational expression defined in advance according to the ratio of the first input signals and the noise components.

Accordingly, noise may be suppressed by using input signals of a plurality of microphones.

Configuration of Acoustic Echo Suppression Gain Calculating Unit

Figure 3:
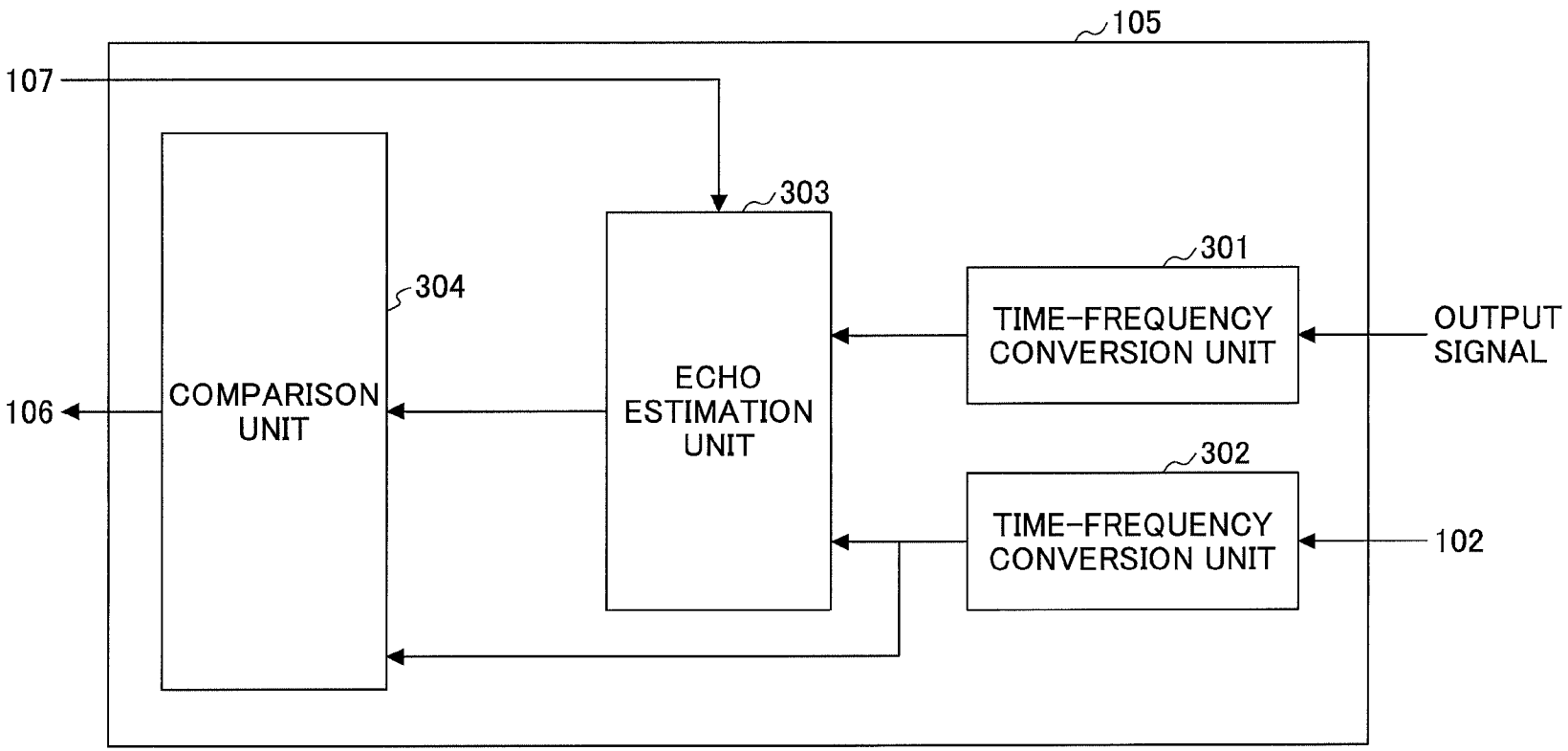
FIG. 3 is a block diagram illustrating an example of the configuration of an acoustic echo suppression gain calculating unit according to the first embodiment.

Next, a description is given of the configuration of the acoustic echo suppression gain calculating unit 105. FIG. 3 is a block diagram illustrating an example of the configuration of the acoustic echo suppression gain calculating unit 105 according to the first embodiment. The acoustic echo suppression gain calculating unit 105 illustrated in FIG. 3 includes a time-frequency conversion unit 301, a time-frequency conversion unit 302, an echo estimation unit 303, and a comparison unit 304.

The time-frequency conversion unit 301 performs time-frequency conversion on the output signals output to the replay device 101, and obtains the spectrum. The time-frequency conversion unit 302 performs time-frequency conversion on the first input signals, and obtains the spectrum. The time-frequency conversion may be, for example, Fast Fourier Transform (FFT).

The time-frequency conversion unit 301 outputs the obtained spectrum of the output signals to the echo estimation unit 303. The time-frequency conversion unit 302 outputs the obtained spectrum of the first input signals to the echo estimation unit 303 and the comparison unit 304.

The echo estimation unit 303 acquires the spectrum of the first input signals, the spectrum of the output signals, and the output signals from the gain application unit 107, and estimates the acoustic echo. The echo estimation unit 303 uses a known technology to estimate the spectrum of acoustic echo components. The estimated spectrum of acoustic echo components is output to the comparison unit 304.

The comparison unit 304 compares the spectrum of the first input signals and the spectrum of the acoustic echo components, and calculates a gain for suppressing the acoustic echo for each frequency. In the following, this gain is also referred to as a "suppression gain of the acoustic echo". The comparison unit 304 sets the ratio of acoustic echo components included in the first input signals as the suppression gain of the acoustic echo. Furthermore, the suppression gain of the acoustic echo may be calculated with a relational expression defined in advance according to the ratio of the first input signals and the acoustic echo components.

Accordingly, it is possible to suppress the acoustic echo of one input signal that is a standard, among the input signals of a plurality of microphones.

Process Overview

Figure 4:
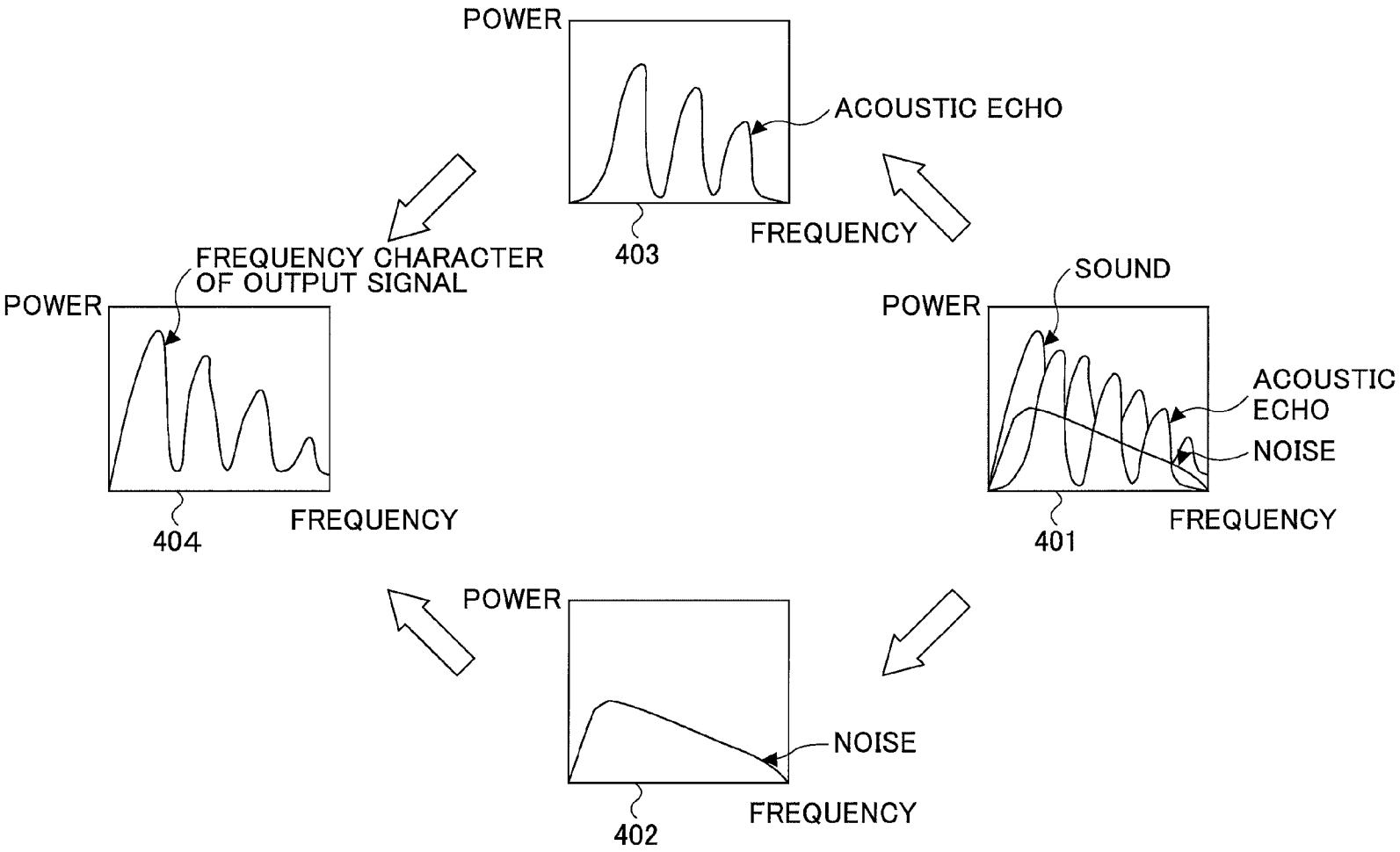
FIG. 4 is a conceptual diagram for describing the overview of processes by the sound processing device.

Next, a description is given of an overview of the processes performed by the sound processing device 1. FIG. 4 is a conceptual diagram for describing the overview of processes by the sound processing device 1.

A frequency character 401 illustrated in FIG. 4 indicates the frequency character (spectrum) of the input signals. For example, the input signals include a voice, an acoustic echo, and noise. A frequency character 402 illustrated in FIG. 4 indicates the frequency character of noise. The frequency character 402 is estimated by the noise suppression gain calculating unit 104. A frequency character 403 illustrated in FIG. 4 indicates the frequency character of an acoustic echo. The frequency character 403 is estimated by the acoustic echo suppression gain calculating unit 105.

The noise suppression gain calculating unit 104 estimates the frequency character 402 of noise, and then calculates the suppression gain of noise. Furthermore, the acoustic echo suppression gain calculating unit 105 estimates the frequency character 403 of an acoustic echo, and then calculates the suppression gain of the acoustic echo.

Next, based on the obtained suppression gain of noise and the obtained suppression gain of the acoustic echo, the gain integration unit 106 obtains a single gain by using a predetermined method. The predetermined method may be any one of Methods 1 through 4 described above.

Next, the gain application unit 107 applies the obtained application gain to one of the input signals that is a standard, so that suppressed output signals are generated in consideration of an acoustic echo and noise. A frequency character 404 illustrated in FIG. 4 indicates the frequency character of output signals output from the gain application unit 107.

Operations

Figure 5:
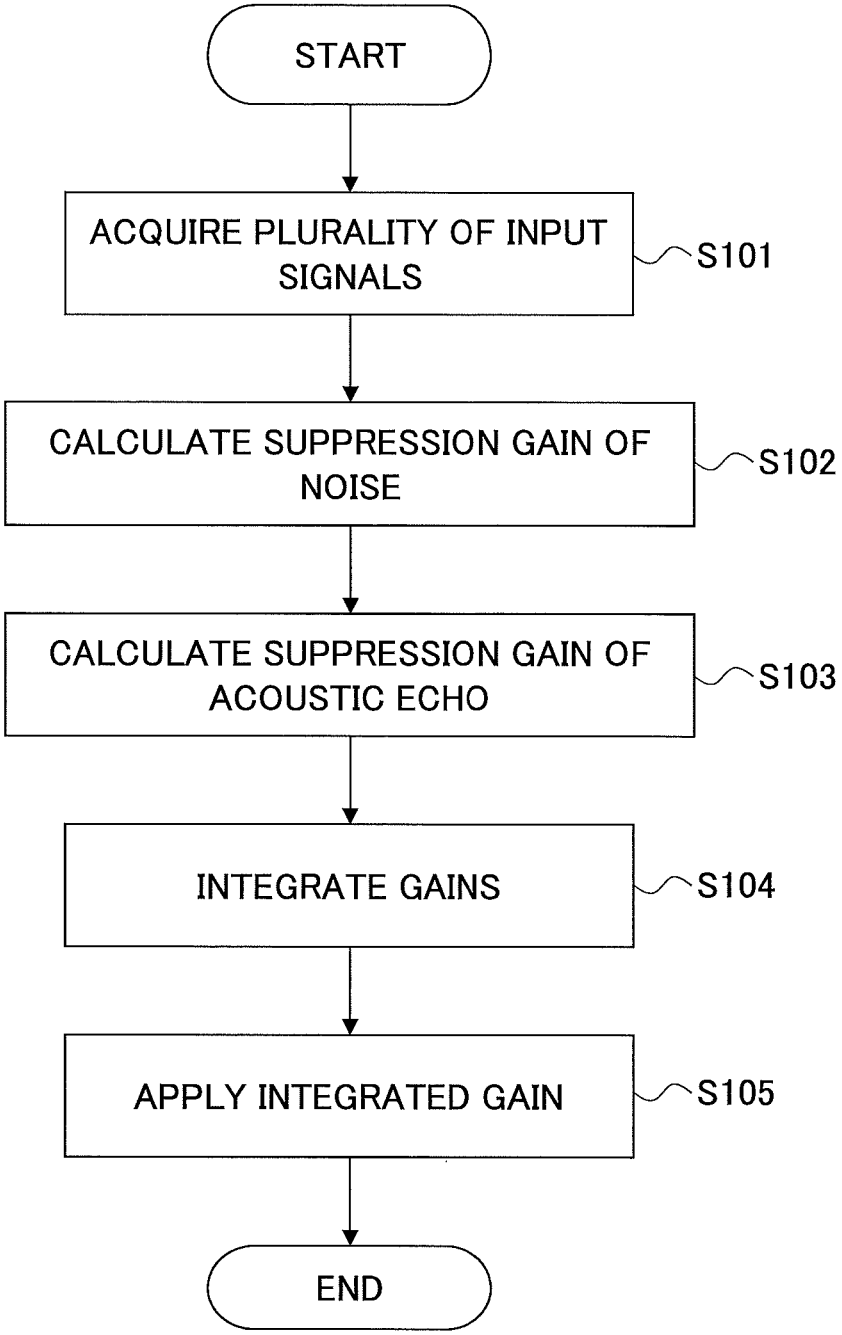
FIG. 5 is a flowchart illustrating an example of sound processing according to the first embodiment.

Next, a description is given of operations of the sound processing device 1 according to the first embodiment. FIG. 5 is a flowchart illustrating an example of sound processing according to the first embodiment. In step S101 in FIG. 5, the sound processing device 1 acquires input signals from a plurality of microphones.

In step S102, the noise suppression gain calculating unit 104 calculates a suppression gain of noise by using a plurality of input signals. The calculation of the suppression gain of noise may be performed by using a known technology.

In step S103, the acoustic echo suppression gain calculating unit 105 calculates a suppression gain of the acoustic echo for a single input signal among a plurality of input signals. The calculation of the suppression gain of the acoustic echo may be performed by using a known technology.

In step S104, the gain integration unit 106 obtains a single gain from the suppression gain of noise and the suppression gain of the acoustic echo. The obtaining method may be any one of methods 1 through 4 described above.

In step S105, the gain application unit 107 applies the integrated gain to one input signal among the plurality of input signals.

As described above, according to the first embodiment, the output signals to which the integrated gain is applied, are suppressed in consideration of the noise and the acoustic echo, and therefore high-quality sound is provided. Furthermore, the process of the echo canceller is performed once, as such there are not as many conditional expressions as the conventional technology, and therefore the calculation amount is reduced.

Second Embodiment

Next, a description is given of a sound processing device 2 according to a second embodiment. In the second embodiment, input signals to be the standard are selected from a plurality of input signals. Accordingly, input signals including many voices of the user, etc., may be used as the reference to perform the process of the embodiment.

Configuration

Figure 6:
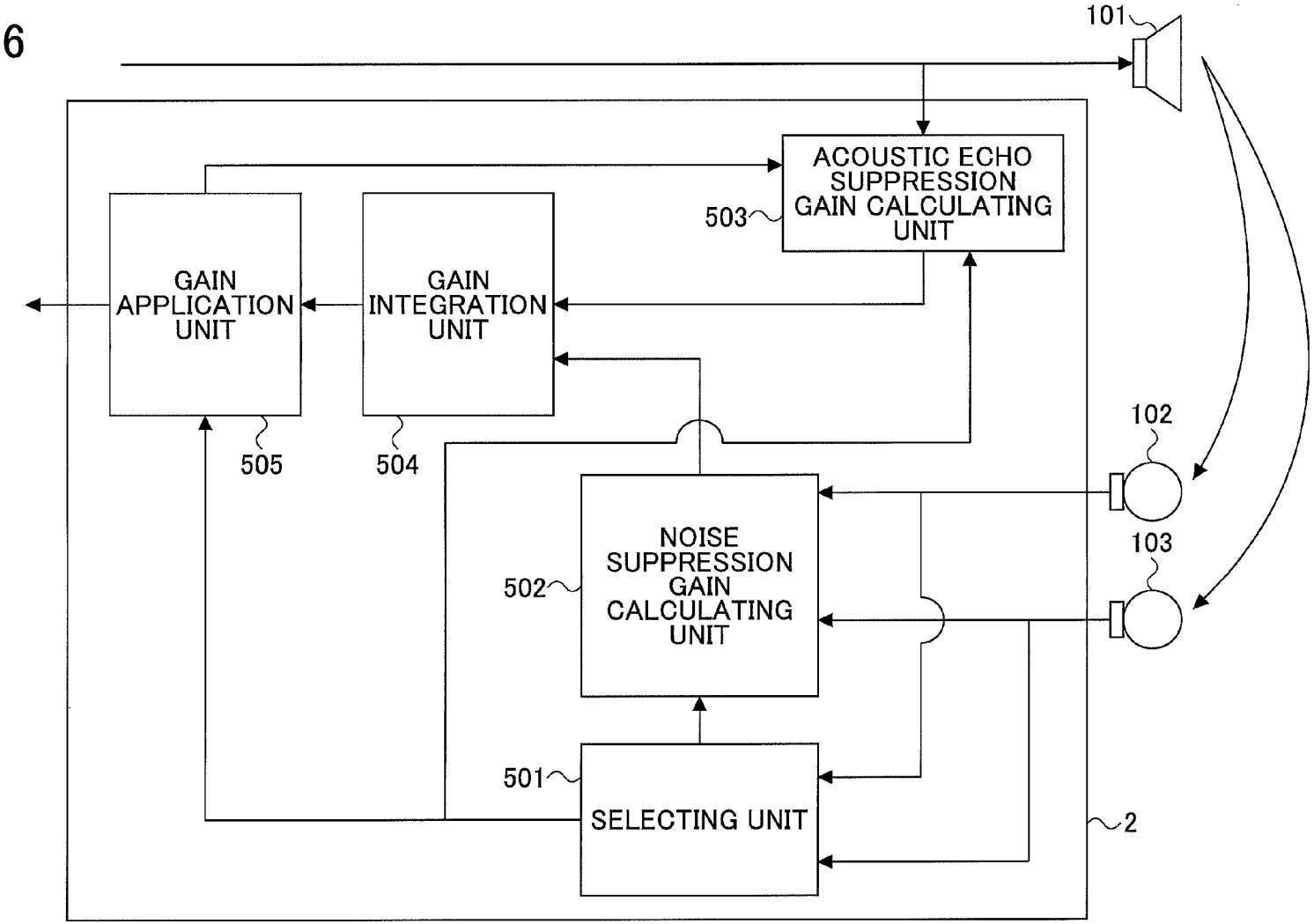
FIG. 6 is a block diagram illustrating an example of the configuration of a sound processing device according to a second embodiment.

FIG. 6 is a block diagram illustrating an example of the configuration of the sound processing device 2 according to the second embodiment. Note that the replay device 101, the first microphone 102, and the second microphone 103 are the same as those of the first embodiment, and are thus denoted by the same reference numerals.

The sound processing device 2 illustrated in FIG. 6 includes a selecting unit 501, a noise suppression gain calculating unit 502, an acoustic echo suppression gain calculating unit 503, a gain integration unit 504, and a gain application unit 505.

Note that the sound processing device 2 may be constituted to include the replay device 101, the first microphone 102, and the second microphone 103. Furthermore, in the example of FIG. 6, there are two microphones; however, there may be three or more microphones.

The selecting unit 501 selects one of the input signals to be the standard, from the input signals input from a plurality of microphones. For example, the selecting unit 501 may select the input signals having the highest sound volume, from among a plurality of input signals.

Furthermore, when there is an illumination intensity sensor provided in the same case as the sound processing device 2, the selecting unit 501 may select one of the input signals according to the output value of the illumination intensity sensor. For example, when the illumination intensity sensor is provided on the same surface as the first microphone 102, and the second microphone 103 is provided on a surface facing this surface, the selecting unit 501 selects the input signals of the first microphone 102 when the output value of the illumination intensity sensor is greater than or equal to a threshold.

For example, when a case including the sound processing device 2 is placed on a desk, and the output value of the illumination intensity sensor is greater than a threshold, it may be determined that the surface on which the first microphone 102 is provided is not in contact with the desk. Therefore, it may be determined that the user is inputting a voice to the first microphone 102.

Furthermore, the selecting unit 501 selects the input signals the second microphone 103, when the output value of the illumination intensity sensor is less than a threshold. When the output value of the illumination intensity sensor is less than a threshold, it may be determined that the surface on which the first microphone 102 is provided is in contact with the desk. Therefore, it may be determined that the user is inputting a voice to the second microphone 103.

The selecting unit 501 outputs the selected input signals to the acoustic echo suppression gain calculating unit 503 and the gain application unit 505. Furthermore, the selecting unit 501 outputs information indicating the selected input signals to the noise suppression gain calculating unit 502.

The basic processes performed by the noise suppression gain calculating unit 502 are the same as those of the first embodiment. A different process is that the noise suppression gain calculating unit 502 selects one of the input signals to be a standard based on information acquired from the selecting unit 501.

The noise suppression gain calculating unit 502 calculates the suppression gain of noise by using the selected input signals as a standard.

The acoustic echo suppression gain calculating unit 503 calculates the suppression gain of the acoustic echo for the input signals acquired from the selecting unit 501. The process of calculating the suppression gain of the acoustic echo is the same as that of the first embodiment.

The gain integration unit 504 performs the same process as that of the gain integration unit 106 of the first embodiment. That is to say, the gain integration unit 504 obtains a single gain from the suppression gain of noise and the suppression gain of the acoustic echo, and outputs the obtained gain to the gain application unit 505.

The gain application unit 505 applies an integrated gain to the input signals acquired from the selecting unit 501. For example, the gain application unit 505 converts the input signals acquired from the selecting unit 501 into frequency components, and multiplies the integrated gain by the spectrum.

Accordingly, input signals estimated to include many voices may be used as a standard to perform the process described in the embodiment.

Configuration of Noise Suppression Gain Calculating Unit

Figure 7:
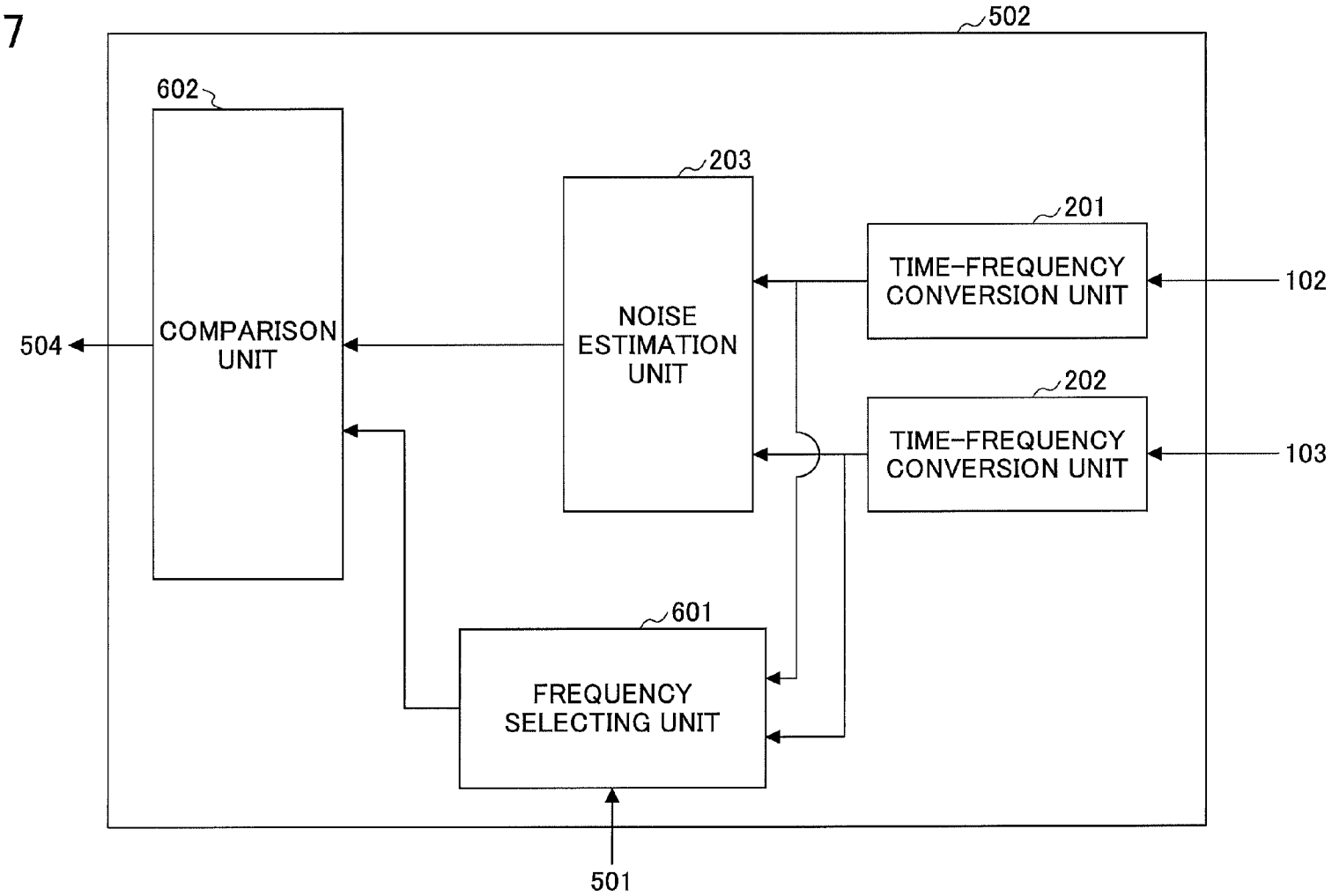
FIG. 7 is a block diagram illustrating an example of the configuration of a noise suppression gain calculating unit according to the second embodiment.

Next, a description is given of the configuration of the noise suppression gain calculating unit 502. FIG. 7 is a block diagram illustrating an example of the configuration of the noise suppression gain calculating unit 502 according to the second embodiment. The noise suppression gain calculating unit 502 illustrated in FIG. 7 includes the time-frequency conversion unit 201, the time-frequency conversion unit 202, the noise estimation unit 203, a frequency selecting unit 601, and a comparison unit 602.

Note that in the configuration of FIG. 7, the same elements as those of FIG. 2 are denoted by the same reference numerals and redundant descriptions are omitted.

The frequency selecting unit 601 acquires a spectrum of the first input signals from the time-frequency conversion unit 201. Furthermore, the frequency selecting unit 601 acquires a spectrum of the second input signals from the time-frequency conversion unit 202.

The frequency selecting unit 601 acquires information indicating the selected input signals from the selecting unit 501, and selects a spectrum of the input signals indicated by this information. The frequency selecting unit 601 outputs the selected spectrum to the comparison unit 602.

The comparison unit 602 compares the spectrum acquired from the frequency selecting unit 601 with the spectrum of the noise components, and calculates a suppression gain of noise for each frequency. The comparison unit 602 outputs the calculated suppression gain of noise to the gain integration unit 504.

Accordingly, a suppression gain of noise may be calculated for the input signals selected by the selecting unit 501.

The configuration of the acoustic echo suppression gain calculating unit 503 according to the second embodiment is the same as that of the first embodiment, and therefore a description thereof is omitted.

Operations

Figure 8:
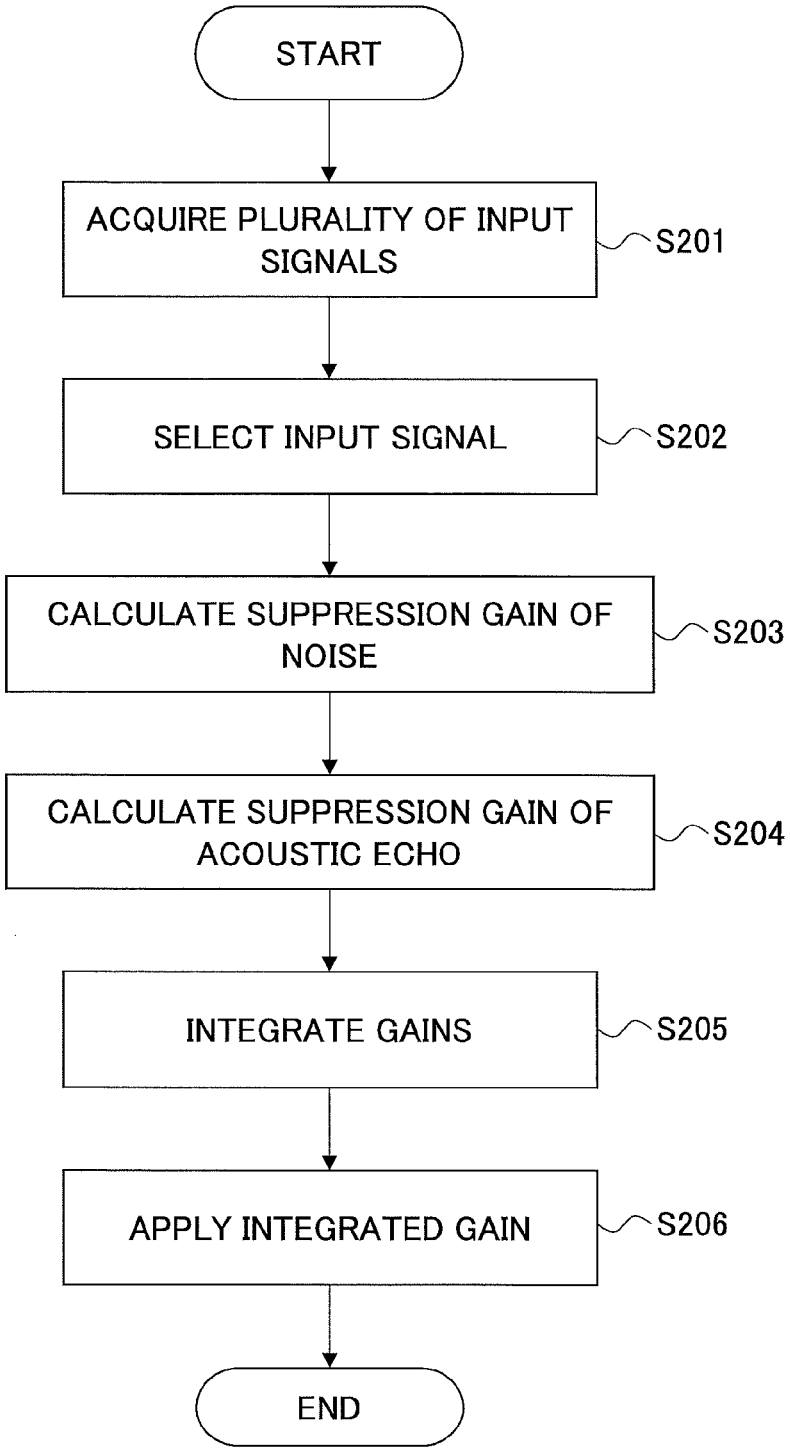
FIG. 8 is a flowchart illustrating an example of sound processing according to the second embodiment.

Next, a description is given of operations of the sound processing device 2 according to the second embodiment. FIG. 8 is a flowchart illustrating an example of sound processing according to the second embodiment. In step S201 of FIG. 8, the sound processing device 2 acquires input signals from a plurality of microphones.

In step S202, the selecting unit 501 selects one of the input signals from a plurality of input signals, based on the output value of the illumination intensity sensor or the sound volume of each of the input signals. The selected input signals are used as a reference in performing the following processes.

The processes of step S203 through S206 are the same as the processes of step S102 through S105 of FIG. 5, and therefore descriptions thereof are omitted.

As described above, according to the second embodiment, for example, the input signals including the most voices are selected from a plurality of input signals, and the selected input signals may be used as a reference. Therefore, even more high-quality sound is provided while suppressing the calculation amount.

Third Embodiment

Figure 9:
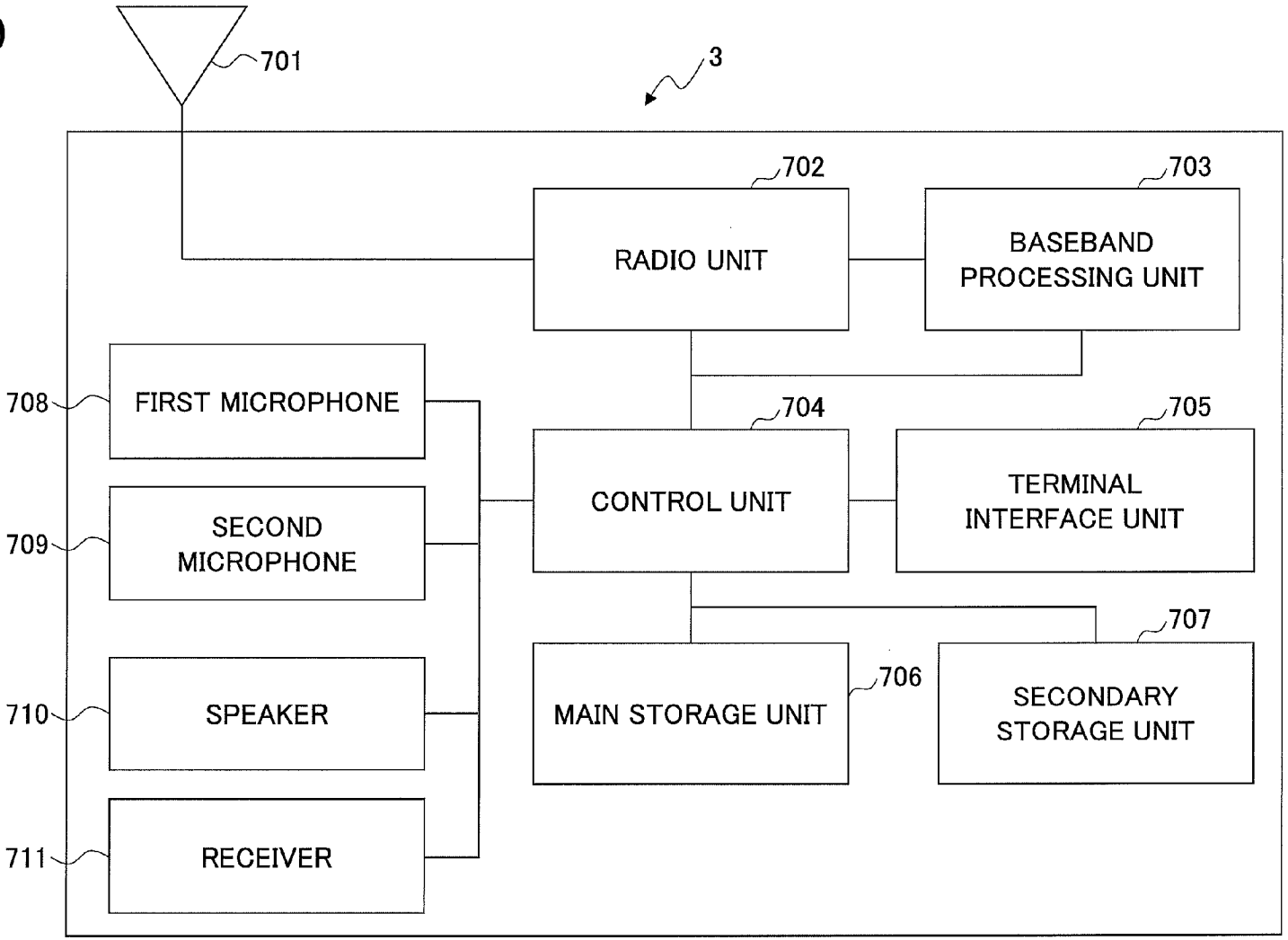
FIG. 9 is a block diagram illustrating an example of hardware of a mobile terminal device according to a third embodiment.

FIG. 9 is a block diagram illustrating an example of hardware of a mobile terminal device 3 according to a third embodiment. The mobile terminal device 3 includes an antenna 701, a radio unit 702, a baseband processing unit 703, a control unit 704, a terminal interface unit 705, a main storage unit 706, a secondary storage unit 707, a first microphone 708, a second microphone 709, a speaker 710, and a receiver 711.

The antenna 701 transmits radio signals amplified by a transmission amplifier, and receives radio signals from a base station. The radio unit 702 performs D/A conversion on the transmission signals diffused at the baseband processing unit 703, converts the signals to high-frequency signals by orthogonal modulation, and amplifies the signals by a power amplifier. The radio unit 702 amplifies the received radio signals, performs A/D conversion on the signals, and transmits the signals to the baseband processing unit 703.

The baseband processing unit 703 performs baseband processing such as adding error-correction codes to the transmission data, data modulation, spread modulation, reverse diffusion of reception signals, determination of reception environment, determination of a threshold of channel signals, and error-correction decoding.

The control unit 704 performs radio control such as transmitting and receiving control signals. Furthermore, the control unit 704 executes a sound processing program stored in the secondary storage unit 707, and performs sound processing described in the embodiments.

The terminal interface unit 705 performs an adapter process for data and an interface process with a hand set and an external data terminal.

The main storage unit 706 is, for example, a ROM (Read-Only Memory) and a RAM (Random-Access Memory), and is a storage device for storing or temporarily saving programs such as an OS (Operating System) that is basic software and application software, which are executed by the control unit 704, and data.

The secondary storage unit 707 is, for example, a HDD (Hard Disk Drive), and is a storage device for storing data relevant to application software. The secondary storage unit 707 stores the sound processing program described above.

The first microphone 708 and the second microphone 709 correspond to the first microphone 102 and the second microphone 103, respectively. The speaker 710 and the receiver 711 correspond to the replay device 101.

Furthermore, the respective units of the sound processing devices 1 and 2 may be implemented by, for example, the control unit 704 and the main storage unit 706 as a work memory.

Next, a description is given of an example of the positional relationship of the first microphone 708, the second microphone 709, the speaker 710, and the receiver 711.

Figure 10A:
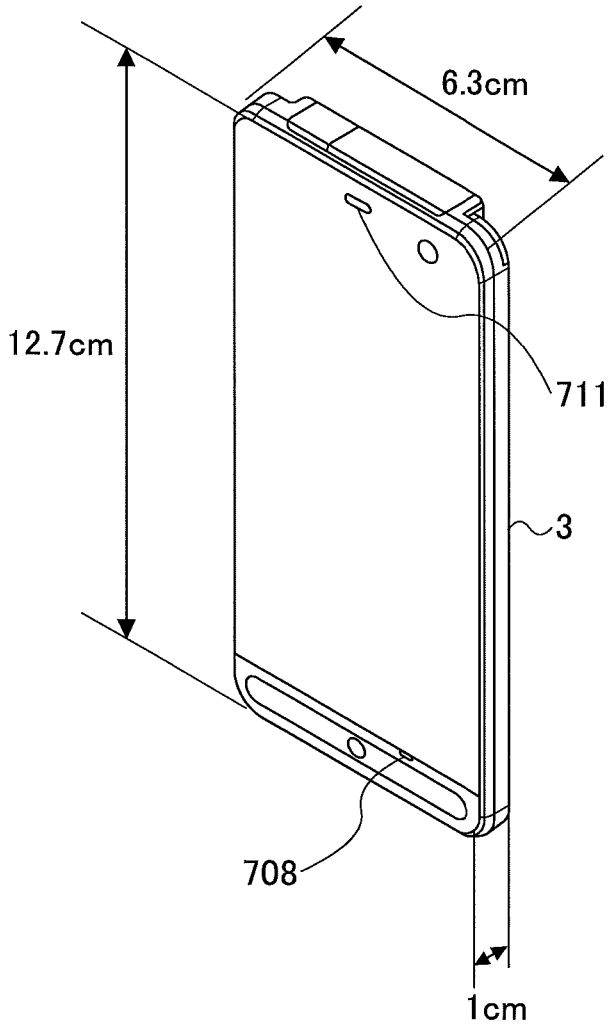
FIG. 10A is a perspective view (part 1) of the mobile terminal device.

FIG. 10A is a perspective view (part 1) of the mobile terminal device 3. In the example illustrated in FIG. 10A, the front side of the mobile terminal device 3 is viewed from the left direction, and the first microphone 708 expresses the front microphone.

Figure 10B:
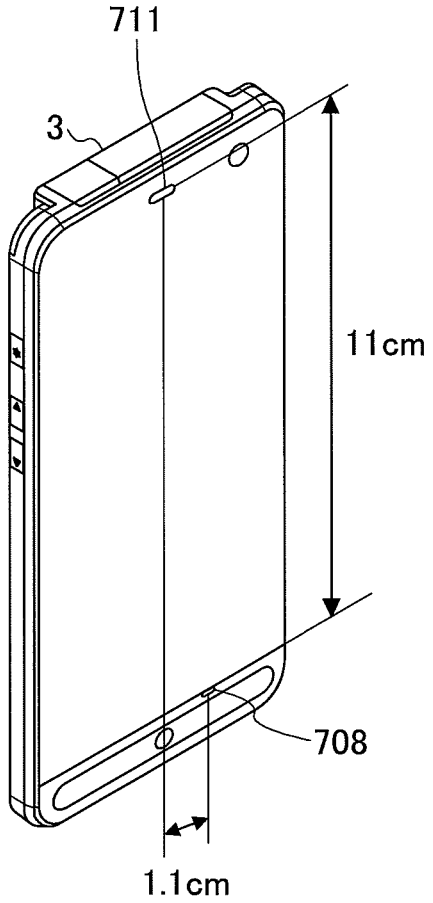
FIG. 10B is a perspective view (part 2) of the mobile terminal device.

FIG. 10B is a perspective view (part 2) of the mobile terminal device 3. In the example illustrated in FIG. 10B, the front side of the mobile terminal device 3 is viewed from the right direction, and the distance between the first microphone 708 and the receiver 711 is expressed.

Figure 10C:
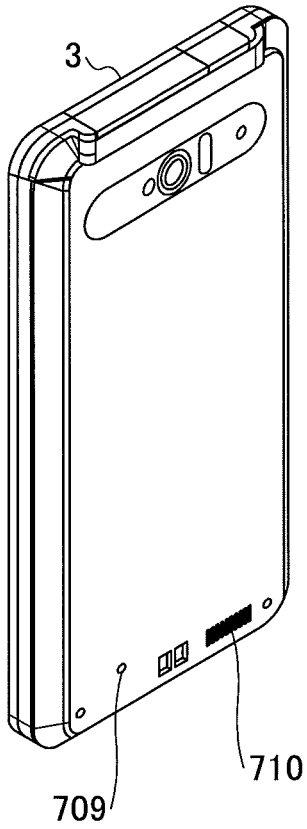
FIG. 10C is a perspective view (part 3) of the mobile terminal device.

FIG. 10C is a perspective view (part 3) of the mobile terminal device 3. In the example illustrated in FIG. 10C, the back side of the mobile terminal device 3 is viewed from the right direction, and the second microphone 709 expresses the rear microphone.

Figure 10D:
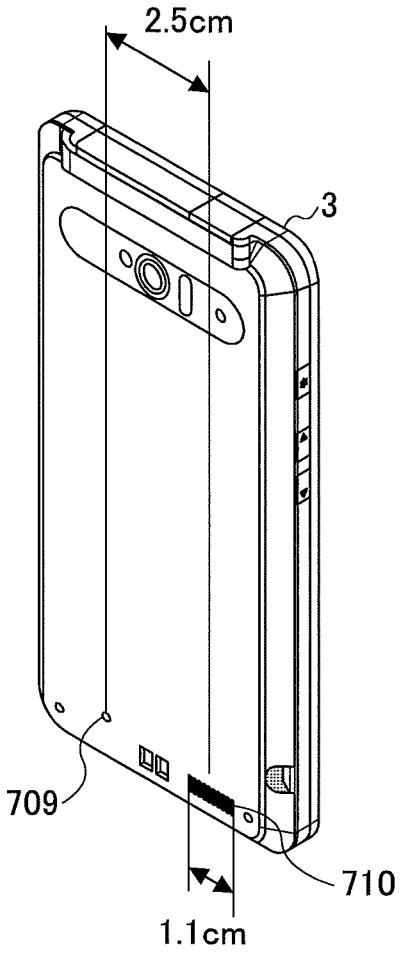
FIG. 10D is a perspective view (part 4) of the mobile terminal device.

FIG. 10D is a perspective view (part 4) of the mobile terminal device 3. In the example illustrated in FIG. 10D, the back side of the mobile terminal device 3 is viewed from the left direction, and the distance between the second microphone 709 and the speaker 710 is expressed.

Thus, as illustrated in FIG. 10, when the microphones are provided on different sides, in order to determine which microphone the user is speaking into, the selecting unit 501 of the second embodiment is effectively used.

Note that the examples of FIGS. 10A through 10D are merely examples; the positional relationship between the plurality of microphones and the replay device is not so limited.

As described above, according to the third embodiment, in the mobile terminal device 3, high-quality sound is provided while suppressing the calculation amount.

Furthermore, the disclosed technology is not limited to the mobile terminal device 3; the disclosed technology may be mounted in other devices. For example, the sound processing devices 1 and 2 described above may be applied to a video teleconference device, an information processing device including a telephone function, a fixed-line phone, and a VoIP (Voice over Internet Protocol) system.

Furthermore, by recording, in a recording medium, the program for implementing the sound processing described above in the embodiments, a computer may be caused to execute the sound processing according to the embodiments.

Furthermore, the sound processing described above may be implemented by recording the program in a recording medium, and causing a computer or a mobile terminal device to read the recording medium recording this program. Note that as the recording medium, various types of recording media may be used, including a recording medium for optically, electrically, or magnetically recording information such as a CD-ROM, a flexible disk, and a magnetic optical disk, and a semiconductor memory for electrically recording information such as a ROM and a flash memory. The recording medium does not include carrier waves.

Embodiments are described in detail above; however, the present invention is not limited to the specific embodiments described herein, and variations and modifications may be made without departing from the scope of the present invention. Furthermore, all of or some of the elements in the embodiments described above may be combined.

According to the disclosed technology, high-quality sound is provided while suppressing the calculation amount.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A sound processing device comprising:

a hardware controller;

a memory storing a program that, when executed by the hardware controller, causes the sound processing device to:

calculate a suppression gain of noise by using respective input signals input from a plurality of microphones;

obtain an integration gain by using a suppression gain of an acoustic echo and the suppression gain of the noise;

apply the integration gain to one input signal among the plurality of input signals;

estimate a spectrum of components of the acoustic echo by using said one input signal to which the integration gain is applied, an output signal that is output to a replay device, and said one input signal before having the integration gain applied thereto; and calculate the suppression gain of the acoustic echo by comparing the estimated spectrum of the components of the acoustic echo and a spectrum of said one input signal before having the integration gain applied thereto;

a baseband unit configured to modulate said one input signal to which the integration gain is applied into a transmission signal;

a radio unit configured to convert the transmission signal to a radio signal; and an antenna configured to transmit the radio signal.

2. The sound processing device according to claim 1, wherein the sound processing device is further caused to select said one input signal from the plurality of input signals, based on an output value of an illumination intensity sensor or a sound volume of the respective input signals.

3. The sound processing device according to claim 1, wherein the sound processing device is further caused to set, as the integrated gain, a lower one of the suppression gain of the acoustic echo and the suppression gain of the noise.

4. The sound processing device according to claim 1, wherein the sound processing device is further caused to set, as the integrated gain, a higher one of the suppression gain of the acoustic echo and the suppression gain of the noise.

5. The sound processing device according to claim 1, wherein the sound processing device is further caused to set, as the integrated gain, an average value of the suppression gain of the acoustic echo and the suppression gain of the noise.

6. The sound processing device according to claim 1, wherein the sound processing device is further caused to set, as the integrated gain, a weighted average value of the suppression gain of the acoustic echo and the suppression gain of the noise.

7. A sound processing method executed by a computer, comprising:

calculating a suppression gain of noise by using respective input signals input from a plurality of microphones;

obtaining an integration gain by using a suppression gain of an acoustic echo and the suppression gain of the noise;

applying the integration gain to one input signal among the plurality of input signals;

estimating a spectrum of components of the acoustic echo by using said one input signal to which the integration gain is applied, an output signal that is output to a replay device, and said one input signal before having the integration gain applied thereto;

calculating the suppression gain of the acoustic echo by comparing the estimated spectrum of the components of the acoustic echo and a spectrum of said one input signal before having the integration gain applied thereto;

modulating said one input signal to which the integration gain is applied into a transmission signal;

converting the transmission signal to a radio signal; and transmitting the radio signal.

8. A non-transitory computer-readable recording medium storing a program that causes a computer, having a baseband unit which modulates an input signal into a transmission signal, a radio unit which converts the transmission signal to a radio signal, and an antenna which transmits the radio signal, to execute a process comprising:

calculating a suppression gain of noise by using respective input signals input from a plurality of microphones;

obtaining an integration gain by using a suppression gain of an acoustic echo and the suppression gain of the noise;

applying the integration gain to one input signal among the plurality of input signals, and outputting said one input signal to which the integration gain is applied to the baseband unit;

estimating a spectrum of components of the acoustic echo by using said one input signal to which the integration gain is applied, an output signal that is output to a replay device, and said one input signal before having the integration gain applied thereto; and calculating the suppression gain of the acoustic echo by comparing the estimated spectrum of the components of the acoustic echo and a spectrum of said one input signal before having the integration gain applied thereto.

* * * * *